US012687078B2

(12) United States Patent
Saponja et al.

(10) Patent No.: US 12,687,078 B2
(45) Date of Patent: Jul. 21, 2026

(54) DOWNHOLE ANCHORING MECHANISM

(71) Applicant: Oilify New-tech Solutions Inc., Calgary (CA)

(72) Inventors: Jeffrey Charles Saponja, Calgary (CA); Robbie Singh Hari, Calgary (CA); Shawn Deugo, Calgary (CA); Stefan Litalien, Calgary (CA); Carl Stretch, Calgary (CA)

(73) Assignee: Oilify New-tech Solutions Inc., Invermere (CA)

( * ) Notice: Subject to any disclaimer, the term of this patent is extended or adjusted under 35 U.S.C. 154(b) by 5 days.

(21) Appl. No.: 17/980,346

(22) Filed: Nov. 3, 2022

(65) Prior Publication Data

US 2023/0272684 A1 Aug. 31, 2023

Related U.S. Application Data

(60) Provisional application No. 63/400,263, filed on Aug. 23, 2022, provisional application No. 63/275,021, filed on Nov. 3, 2021.

(51) Int. Cl.
*E21B 23/01* (2006.01)

(52) U.S. Cl.
CPC ..... *E21B 23/01* (2013.01)

(58) Field of Classification Search
CPC ..... E21B 23/01; E21B 43/34; E21B 43/38; E21B 40/001
See application file for complete search history.

(56) References Cited

U.S. PATENT DOCUMENTS 1,900,371 A 3/1933 Smith
2,221,797 A * 11/1940 Hertel ..... E21B 23/01 166/210
2,327,963 A 8/1943 Haas
2,765,855 A * 10/1956 Reed ..... E21B 23/01 166/215

(Continued)

OTHER PUBLICATIONS

"American Piping Products, Pipe Dimension Chart, Dec. 11, 2015". Sourced from https://web.archive.org/web/20151211072706/https://amerpipe.com/wp-content/uploads/2015/10/APP-chart-v7-web.pdf (Year: 2015).*

(Continued)

*Primary Examiner* — Tara Schimpf
*Assistant Examiner* — Ursula Lee Norris
(74) *Attorney, Agent, or Firm* — Smart & Biggar LP

(57) ABSTRACT

There is provided an anchoring mechanism configured for coupling to a flow conductor, emplaceable within a wellbore that is lined with casing, wherein the anchoring mechanism is configurable in an anchoring-effective state for effectuating anchoring of the flow conductor to the casing, wherein: the anchoring mechanism is co-operable with the casing such that, while: (i) the anchoring mechanism is coupled to the flow conductor that is disposed within the wellbore that is lined with the casing, and (ii) the anchoring mechanism is disposed in the anchoring-effective state such that the flow conductor is anchored by the anchoring mechanism to the casing, the flow conductor is eccentrically disposed relative to the central longitudinal axis of the wellbore.

20 Claims, 12 Drawing Sheets

(56) References Cited

U.S. PATENT DOCUMENTS

| | | | | |
|---|---|---|---|---|
| 3,292,708 | A * | 12/1966 | Mundt | E21B 17/1078 166/173 |
| 3,664,417 | A | 5/1972 | Conrad | |
| 3,800,871 | A * | 4/1974 | Watson | E21B 23/0419 166/212 |
| 5,327,975 | A | 7/1994 | Land | |
| 6,315,043 | B1 * | 11/2001 | Farrant | E21B 23/0412 166/63 |
| 6,796,380 | B2 | 9/2004 | Xu | |
| 6,892,811 | B2 * | 5/2005 | LaClare | E21B 33/04 166/217 |
| 9,157,289 | B1 | 10/2015 | Bair et al. | |
| 9,169,703 | B2 | 10/2015 | Larsen et al. | |
| 10,006,264 | B2 * | 6/2018 | Glaser | E21B 23/12 |
| 10,400,532 | B2 * | 9/2019 | Holly | E21B 23/01 |
| 10,450,816 | B2 | 10/2019 | Bringham | |
| 11,220,881 | B2 | 1/2022 | Zachry et al. | |
| 11,649,687 | B1 | 5/2023 | Dawson | |
| 2018/0087335 | A1 * | 3/2018 | Weckend | E21B 47/09 |
| 2021/0010339 | A1 | 1/2021 | Scruggs | |
| 2022/0397019 | A1 | 12/2022 | Frost et al. | |
| 2023/0399903 | A1 | 12/2023 | Stachowiak, Jr. | |

OTHER PUBLICATIONS

Tubular Size Chart as previously supplied in the NonFinal Office Action dated Aug. 1, 2024.*

Technical Specification Sheet, Black Gold Hydraulic Anchor, https://www.blackgoldpump.com/hydraulic-tubing-anchors, accessed Jul. 7, 2023.

* cited by examiner

DOWNHOLE ANCHORING MECHANISM

CROSS-REFERENCE TO RELATED APPLICATION

This application claims the benefits of priority to U.S. Provisional Patent Application No. 63/275,021, filed Nov. 3, 2021, titled TOOL WITH ANCHOR AND SCRAPER, and U.S. Provisional Patent Application No. 63/400,263, filed Aug. 23, 2022, titled DOWNHOLE ANCHORING MECHANISM, the contents of which are hereby expressly incorporated into the present application by reference in their entirety.

FIELD

The present disclosure relates to a downhole anchoring mechanism for anchoring of a flow conductor, such as, for example, a production string, to a casing string.

BACKGROUND

To produce reservoir fluids from a reservoir disposed within a subterranean formation, a flow conductor (such as, for example, a production string) is installed within a wellbore that is lined with a casing string. It is desirable to anchor the flow conductor to the casing string. When anchoring the production string to the casing string, it is desirable to mitigate flow disturbance presented by the anchor.

SUMMARY

In one aspect, there is provided an anchoring mechanism configured for coupling to a flow conductor, emplaceable within a wellbore that is lined with casing, wherein the anchoring mechanism is configurable in an anchoring-effective state for effectuating anchoring of the flow conductor to the casing, wherein: the anchoring mechanism is co-operable with the casing such that, while: (i) the anchoring mechanism is coupled to the flow conductor that is disposed within the wellbore that is lined with the casing, and (ii) the anchoring mechanism is disposed in the anchoring-effective state such that the flow conductor is anchored by the anchoring mechanism to the casing, the flow conductor is eccentrically disposed relative to the central longitudinal axis of the wellbore.

In another aspect, there is provided a downhole tool configured for emplacement within a wellbore that is lined with casing, comprising: a casing engagement configuration configured for engaging the casing; and a pusher; wherein: the casing engagement configuration and the pusher are co-operatively coupled such that: (i) the casing engagement configuration is axially moveable with the pusher, and (ii) the pusher is rotatable relative to the casing engagement configuration.

In another aspect, there is provided an anchoring mechanism configured for coupling to a flow conductor, that is emplaceable within a wellbore that is lined with casing, wherein the anchoring mechanism is configurable in an anchoring-effective state for effectuating anchoring of the flow conductor to the casing, comprising: at least one anchor, wherein at least one of the at least one anchor is a cavity-retained anchor; wherein:

for each one of the at least one cavity-retained anchor, independently, the anchoring mechanism defines a respective anchor-retaining cavity, a respective actuator tool communicator, and a respective casing communicator; and for each one of the at least one cavity-retained anchor, independently, the cavity-retained anchor, the respective anchor-retaining cavity, the respective actuator tool communicator, and the respective casing communicator are co-operatively configured such that:

the cavity-retained anchor is retained to the anchoring tool within the respective anchor-retaining cavity; and while the anchoring mechanism is coupled to the flow conductor and disposed within the wellbore that is lined with the casing, the cavity-retained anchor, the respective anchor-retaining cavity, the respective actuator tool communicator, and the respective casing communicator are co-operable with an actuator tool that is disposed within the wellbore, such that, while the actuator tool is disposed in contact engagement with the cavity-retained anchor through the respective actuator tool communicator and a force is being applied to the actuator tool, the cavity-retained anchor is urged by the actuator tool into contact engagement with the casing via the casing communicator.

In another aspect, there is provided an anchoring mechanism configured for coupling to a flow conductor that is emplaceable within a wellbore that is lined with casing, wherein the anchoring mechanism is transitionable from an anchoring ineffective state to the anchoring effective state for effectuating anchoring of the flow conductor to the casing, comprising: an anchoring tool includes an anchor configuration that includes a plurality of anchors that are circumferentially spaced relative to one another;

wherein:

the anchoring tool is co-operable with the casing such that:

while the anchoring mechanism is coupled to the flow conductor that is disposed within the wellbore that is lined with casing, the transitioning is with effect that each one of the plurality of anchors, independently, becomes displaced outwardly relative to the central longitudinal axis of the flow conductor, such that the anchoring of the flow conductor to the casing is established; and while the anchoring of the flow conductor to the casing is established, for each adjacent pair of anchors, independently, the anchors are spaced apart by a minimum distance of at least 0.5 inches.

In another aspect, there is provided an anchoring mechanism configured for coupling to a flow conductor, emplaceable within a wellbore that is lined with casing, comprising:

a scraper configured for scraping a portion of the casing such that a conditioned casing portion is obtained; and an anchor for anchoring the flow conductor to the conditioned casing portion In another aspect, there provided an anchoring mechanism configured for coupling to a flow conductor that is emplaceable within a wellbore, wherein the anchoring mechanism is transitionable from an anchoring ineffective state to an anchoring effective state for effectuating anchoring of the flow conductor to the casing, wherein the transitioning from the anchoring ineffective state to the anchoring effective state is responsive to an axial displacement of the anchoring mechanism, in the downhole direction, that is greater than a length by which a partially-assembled flow conductor is lifted for coupling of an additional joint of tubing during assembly of the flow conductor.

In another aspect, there is provided an anchoring mechanism configured for coupling to a flow conductor that is emplaceable within a wellbore, wherein the anchoring mechanism is transitionable from an anchoring ineffective state to an anchoring effective state for effectuating anchoring of the flow conductor to the casing, wherein the transitioning from the anchoring ineffective state to the anchoring effective state is responsive to an axial displacement of the anchoring mechanism, in the downhole direction, is greater than 12 inches.

BRIEF DESCRIPTION OF DRAWINGS

In the figures, which illustrate example embodiments.

DETAILED DESCRIPTION

Figure 1:
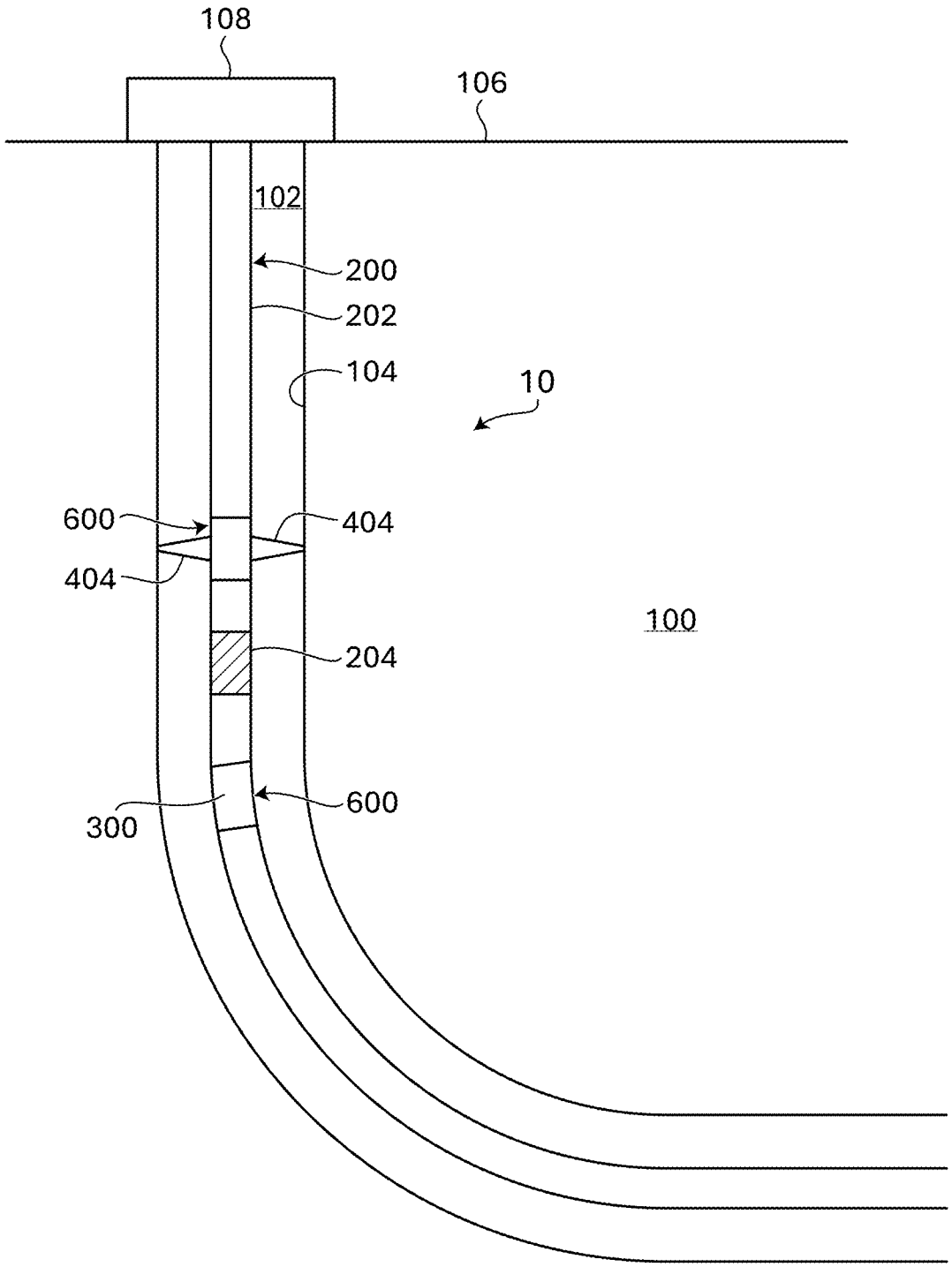
FIG. 1 is a schematic illustration of an embodiment of a system, of the present disclosure.

Disclosed herein is an anchoring mechanism 300 that is configured to anchor a flow conductor 200, disposed within a wellbore 102, to a casing 104 that is lining the wellbore 102. The flow conductor 200 defines a flow passage for conducting reservoir fluid. In some embodiments, for example, the flow conductor 200 is defined by a production string 202. In some embodiments, for example, the flow conductor 200 is defined by coiled tubing.

The anchoring mechanism 300 includes an anchoring tool 400 and an actuator tool 500. The anchoring tool 400 and the actuator tool 500 are co-operatively configured such that the anchoring tool 400 is actuatable by the actuator tool 500 for effectuating anchoring of the flow conductor 200 to the casing 104. In this respect, the anchoring mechanism 300 is configurable in an anchoring-effective state. Also in this respect, the anchoring mechanism 300 is co-operable with the casing 104, such that, while the anchoring mechanism 300 is coupled to a flow conductor 200 that is disposed within the wellbore 102 that is lined with the casing 104 and disposed in the anchoring-effective state, the flow conductor 200 is anchored to the casing 104 by the anchoring mechanism 300. The anchoring mechanism 300 is transitionable from an anchoring-ineffective state to the anchoring effective state. In this respect, the anchoring mechanism 300 is co-operable with the casing 104, such that, while the anchoring mechanism 300 is coupled to a flow conductor 200 that is disposed within the wellbore 102 that is lined with the casing 104 and disposed in the anchoring-ineffective state, there is an absence of anchoring of the flow conductor 200 to the casing 104 by the anchoring mechanism 300.

As used herein, the terms "up", "upward", "upper", or "uphole", mean, relativistically, in closer proximity to the surface 106 and further away from the bottom of the wellbore 102, when measured along the longitudinal axis of the wellbore 102. The terms "down", "downward", "lower", or "downhole" mean, relativistically, further away from the surface 106 and in closer proximity to the bottom of the wellbore 102, when measured along the longitudinal axis of the wellbore 102.

Referring to FIG. 1, there is provided a system 10, for producing hydrocarbon material, via the wellbore 102, from a reservoir, disposed within a subterranean formation 100, to the surface 106.

The wellbore 102 can be straight, curved, or branched. The wellbore 102 can have various wellbore portions. A wellbore portion is an axial length of a wellbore 102. A wellbore portion can be characterized as "vertical" or "horizontal" even though the actual axial orientation can vary from true vertical or true horizontal, and even though the axial path can tend to "corkscrew" or otherwise vary. The term "horizontal", when used to describe a wellbore portion, refers to a horizontal or highly deviated wellbore portion as understood in the art, such as, for example, a wellbore portion having a longitudinal axis that is between about 70 and about 110 degrees from vertical. The term "vertical", when used to describe a wellbore portion, refers to a vertical or highly deviated vertical portion as understood in the art, such as, for example, a wellbore portion having a longitudinal axis that is less than about 20 degrees from the vertical.

"Reservoir fluid" is fluid that is contained within the reservoir. Reservoir fluid may be liquid material, gaseous material, or a mixture of liquid material and gaseous material. In some embodiments, for example, the reservoir fluid includes water and hydrocarbons, such as oil, natural gas condensates, or any combination thereof.

Fluids may be injected into the oil reservoir through the wellbore to effect stimulation of the reservoir fluid. For example, such fluid injection is effected during hydraulic fracturing, water flooding, water disposal, gas floods, gas disposal (including carbon dioxide sequestration), steam-assisted gravity drainage ("SAGD") or cyclic steam stimulation ("CSS"). In some embodiments, for example, the same wellbore is utilized for both stimulation and production operations, such as for hydraulically fractured formations or for formations subjected to CSS. In some embodiments, for example, different wellbores are used, such as for formations subjected to SAGD, or formations subjected to waterflooding.

The casing 104 is employed within the wellbore 102 for stabilizing the subterranean formation 100. In some embodiments, for example, the wellbore string 104 also contributes to effecting fluidic isolation of one zone within the subterranean formation 100 from another zone within the subterranean formation 100.

The fluid productive portion of the wellbore 102 may be completed either as a cased-hole completion or an open-hole completion.

A cased-hole completion involves running the casing 104 down into the wellbore through the production zone.

In some embodiments, for example, the annular region between the deployed wellbore casing 104 and the subterranean formation 100 is filled with cement for effecting zonal isolation (see below). The cement is disposed between the wellbore casing and the oil reservoir for the purpose of effecting isolation, or substantial isolation, of one or more zones of the oil reservoir from fluids disposed in another zone of the oil reservoir. Such fluids include reservoir fluid being produced from another zone of the oil reservoir (in some embodiments, for example, such reservoir fluid being flowed through a production tubing string disposed within and extending through the wellbore casing to the surface), or injected fluids such as water, gas (including carbon dioxide), or stimulations fluids such as fracturing fluid or acid. In this respect, in some embodiments, for example, the cement is provided for effecting sealing, or substantial sealing, of flow communication between one or more zones of the oil reservoir and one or more others zones of the oil reservoir (for example, such as a zone that is being produced). By effecting the sealing, or substantial sealing, of such flow communication, isolation, or substantial isolation, of one or more zones of the oil reservoir, from another subterranean zone (such as a producing formation), is achieved. Such isolation or substantial isolation is desirable, for example, for mitigating contamination of a water table within the oil reservoir by the reservoir fluid (e.g. oil, gas, salt water, or combinations thereof) being produced, or the above-described injected fluids.

In some embodiments, for example, the cement is disposed as a sheath within an annular region between the wellbore casing and the oil reservoir. In some embodiments, for example, the cement is bonded to both of the casing 104 and the subterranean formation 100.

In some embodiments, for example, the cement also provides one or more of the following functions: (a) strengthens and reinforces the structural integrity of the wellbore, (b) prevents, or substantially prevents, produced reservoir fluid of one zone from being diluted by water from other zones. (c) mitigates corrosion of the wellbore casing, (d) at least contributes to the support of the wellbore casing, and e) allows for segmentation for stimulation and fluid inflow control purposes.

The cement is introduced to an annular region between the casing 104 and the subterranean formation 100 after the subject wellbore casing 104 has been run into the wellbore. This operation is known as "cementing".

In some embodiments, for example, the wellbore casing 104 includes one or more casing strings, each of which is positioned within the well bore, having one end extending from the well head. In some embodiments, for example, each casing string is defined by jointed segments of pipe. The jointed segments of pipe typically have threaded connections.

Typically, a wellbore contains multiple intervals of concentric casing strings, successively deployed within the previously run casing. With the exception of a liner string, casing strings typically run back up to the surface 106. Typically, casing string sizes are intentionally minimized to minimize costs during well construction. Generally, smaller casing sizes make production and artificial lofting more challenging.

For wells that are used for producing reservoir fluid, few of these actually produce through wellbore casing. This is because producing fluids can corrode steel or form undesirable deposits (for example, scales, asphaltenes or paraffin waxes) and the larger diameter can make flow unstable. In this respect, a production string 202 is usually installed inside the last casing string. The production string 202 is provided to conduct reservoir fluid, received within the wellbore, to a wellhead 108, from which the production string 202 is hung. In some embodiments, for example, the annular region between the last casing string and the production string 202 may be sealed at the bottom by a packer.

To facilitate flow communication between the reservoir and the wellbore 102, the wellbore casing 104 may be perforated, or otherwise include per-existing ports (which may be selectively openable, such as, for example, by shifting a sleeve), to provide a fluid passage for enabling flow of reservoir fluid from the reservoir to the wellbore 102.

In some embodiments, for example, the entirety of the wellbore casing 104 does not extend back to the wellhead 108, and the lowermost section of the wellbore casing 104 is set short of total depth. Hanging off from the bottom of that portion of the wellbore casing 104 that extends back to the wellhead 108, with a liner hanger or packer, is a liner string. The liner string can be made from the same material as the casing string, but, unlike the casing string, the liner string does not extend back to the wellhead 116. Cement may be provided within the annular region between the liner string and the oil reservoir for effecting zonal isolation (see below), but is not in all cases. In some embodiments, for example, this liner is perforated to effect flow communication between the reservoir and the wellbore. In this respect, in some embodiments, for example, the liner string can also be a screen or is slotted. In some embodiments, for example, the production tubing string may be engaged or stung into the liner string, thereby providing a fluid passage for conducting the produced reservoir fluid to the wellhead 108. In some embodiments, for example, no cemented liner is installed, and this is called an open hole completion or uncemented casing completion.

An open-hole completion is effected by drilling down to the top of the producing formation, and then lining the wellbore with the casing 104. The wellbore is then drilled through the producing formation, and the bottom of the wellbore is left open (i.e. uncased), to effect flow communication between the reservoir and the wellbore. Open-hole completion techniques include bare foot completions, pre-drilled and pre-slotted liners, and open-hole sand control techniques such as stand-alone screens, open hole gravel packs and open hole expandable screens. Packers and casing can segment the open hole into separate intervals and ported subs can be used to effect flow communication between the reservoir and the wellbore.

Referring to FIG. 1, a system 10 is provided for effecting production of reservoir fluid from the reservoir of the subterranean formation 100. The system 10 includes the flow conductor 200 (which, in some embodiments, for example, is defined by a production string 202) that is disposed within the wellbore 102.

The production string 202 further includes a pump 204. The pump 204 is provided to, through mechanical action, pressurize and effect conduction of the reservoir fluid from the subterranean formation 100, through the wellbore 102, and to the surface 106, and thereby effect production of the reservoir fluid. It is understood that the reservoir fluid being conducted uphole through the wellbore 102, via the production string 202, may be additionally energized by supplemental means, including by gas-lift. In some embodiments, for example, the pump 204 is a sucker rod pump. Other suitable pumps 204 include progressive cavity screw pumps, electrical submersible pumps, and jet pumps.

The pump 204 is configured for inducing flow of reservoir fluid, via a downhole portion of the flow conductor 200, from the subterranean formation 100 to the pump suction, pressurizing the reservoir fluid flow, and discharging the pressurized reservoir fluid flow for flow through an uphole portion of the flow conductor 200 to the surface 106.

As discussed above, the wellbore 102 is disposed in fluid communication (such as through perforations provided within the installed casing or liner, or by virtue of the open hole configuration of the completion), or is selectively disposable into fluid communication (such as by perforating the installed casing, or by actuating a valve to effect opening of a port), with the reservoir of the subterranean formation 100. When disposed in fluid communication with the reservoir of the subterranean formation 100, the wellbore 102 is disposed for receiving reservoir fluid flow from the reservoir 104.

During operation of the pump 204 to produce reservoir fluid at the surface 106, it is desirable to anchor the flow conductor 200 to the casing 104 for maintaining tension in the flow conductor 200 and reducing movement of the flow conductor 200. By maintaining tension in the flow conductor 200 and reducing movement of the flow conductor 200 during operation of the pump 204, pump efficiency may be increased, and maintenance and down time caused by wear and tear of the flow conductor 200 and the pump 204, may be decreased. The anchoring mechanism 300, is provided to, amongst other things, perform these functions. In this respect, in some embodiments, for example, the anchoring mechanism 300 is emplaceable uphole relative to the pump 200 and is connected to the flow conductor 200. In some embodiments, for example, the anchoring mechanism 300 is emplaceable downhole relative to the pump 200 when connected to the flow conductor 200.

Figure 2:
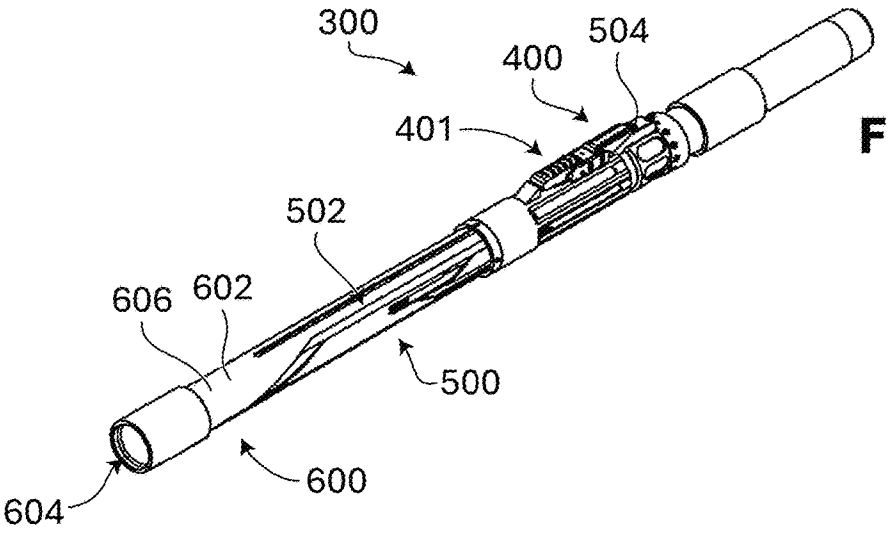
FIG. 2 is a perspective view of an embodiment of an anchoring mechanism.
Figure 3:
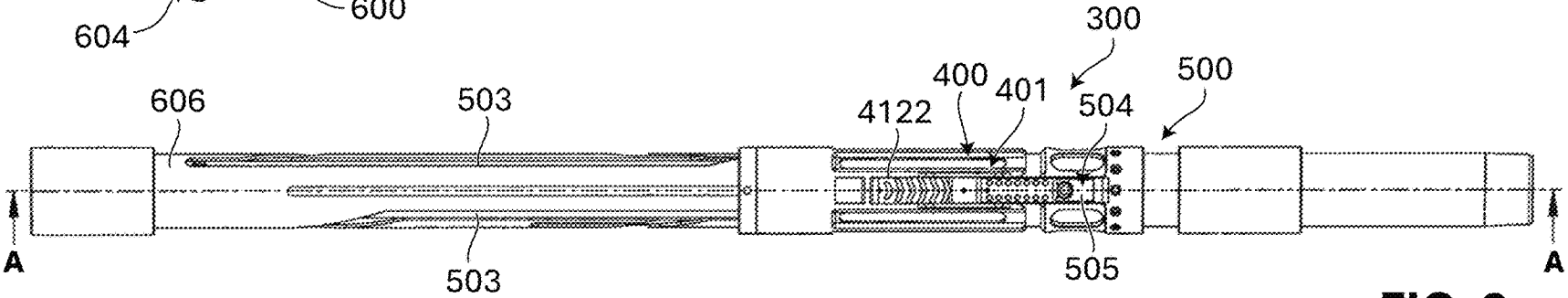
FIG. 3 is a top plan view of the anchoring mechanism illustrated in FIG. 2.
Figure 4:
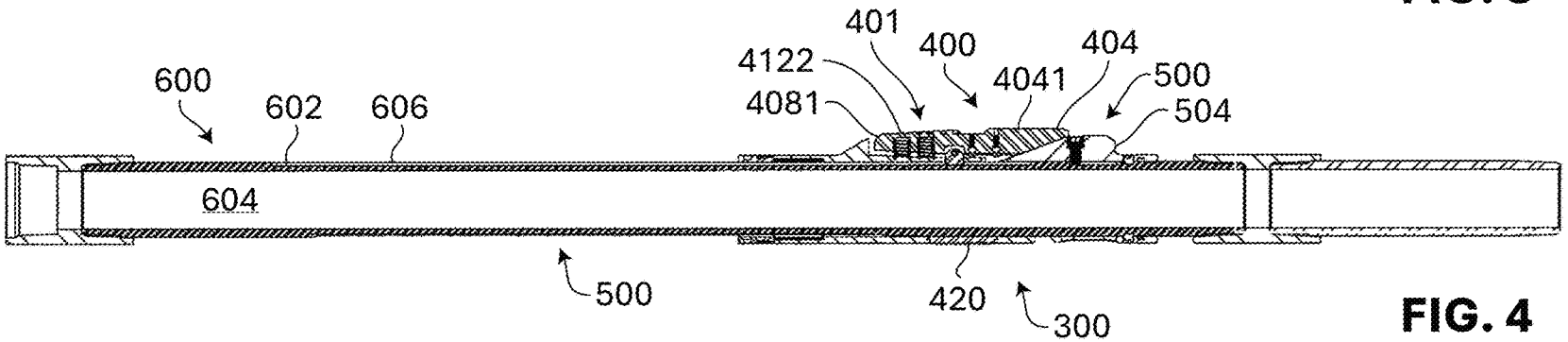
FIG. 4 is a sectional view of the anchoring mechanism illustrated in FIG. 3, taken along lines A-A.
Figure 5:
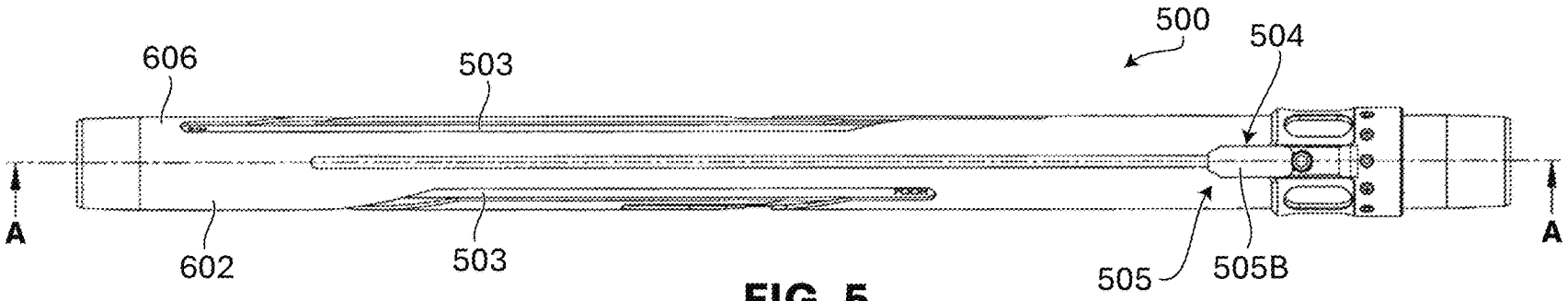
FIG. 5 is a top plan view of an embodiment of an actuator tool.
Figure 6:
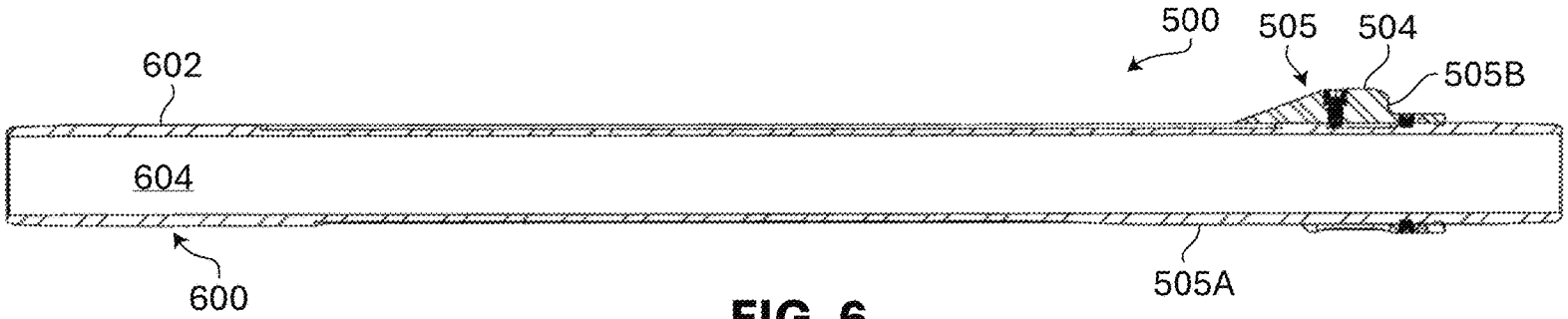
FIG. 6 is sectional view of the actuator tool illustrated in FIG. 5, taken along lines A-A.
Figure 7:
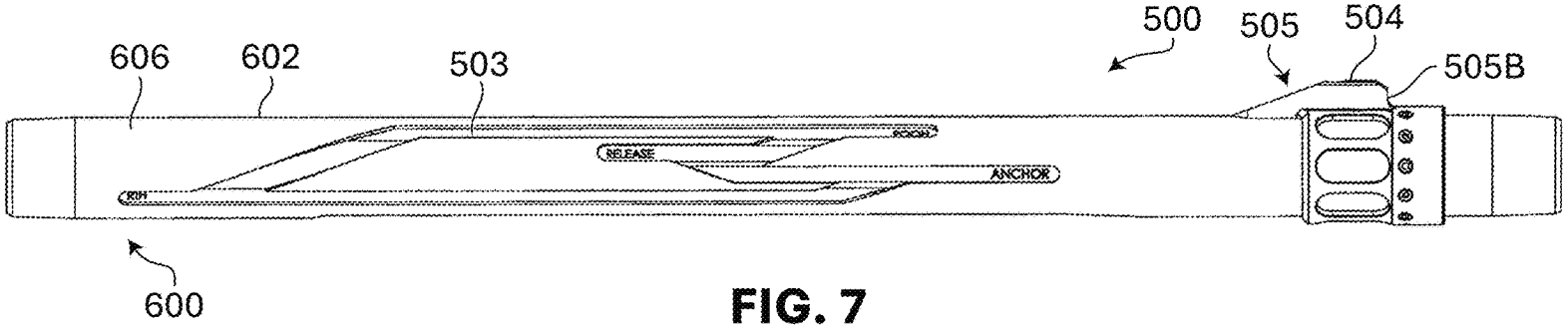
FIG. 7 is a side view of the actuator tool illustrated in FIG. 5.

FIGS. 2 to 4 depict an embodiment of the anchoring mechanism 300, wherein the actuator tool 500 is part of the downhole tool 600 that also defines a portion of the flow passage of the flow conductor 200.

The actuator tool 500 is configured for actuating the anchoring tool 500 for anchoring the flow conductor 200 to the casing 104. In some embodiments, for example, the actuator tool 500 is embodied within a mandrel 602, of the downhole tool 600, and the mandrel 602 also defines a passage 604 which functions as a portion of a flow passage of the flow conductor 200 and, in this respect, the mandrel 602 defines a portion of the flow conductor 200 (e.g. the production string 202).

In some embodiments, for example, an external surface 606 of the mandrel 602 defines a j-slot configuration 502 of the actuator tool 500. The j-slot configuration 502 is defined by at least one j-slot 503. In some embodiments, for example, and as described herein, the j-slot configuration 502 is defined by at least two j-slots 503 (see FIGS. 5 to 7, and FIGS. 19A-D). The j-slot configuration 502 is co-operable with the anchoring tool 400 for effectuating setting (e.g. transitioning the anchoring mechanism 300 from the anchoring-ineffective state to the anchoring-effective state) and unsetting (e.g. transitioning the anchoring mechanism 300 from the anchoring-effective state to the anchoring-ineffective state) of the anchoring tool 400 in response to uphole and downhole movements of the flow conductor 200, as is described below. The j-slot configuration 502 enables relative movement between the flow conductor 200 (and, therefore, the actuator tool 500) and the anchoring tool 400.

In some embodiments, for example, the actuator tool 500 further includes a wedge configuration 504 for urging the actuation of the anchoring tool 400. In some embodiments, for example, the wedge configuration 504 is defined by at least one wedge 505 (in the illustrated embodiment, for example, the wedge 505 is in the form of a ramp 505). In those embodiments where the actuation tool 500 includes a j-slot configuration 502, actuation of the anchoring tool 400 by the wedge configuration 504 is dependent on positioning of the anchoring tool 400 relative to the actuator tool 500, such relative positioning being based on, for each one of the at least one j-slot 503, position of the anchoring tool 400 within the j-slot 503, and such relative positioning being capable of modification in response to movement of the anchoring tool 400 through the at least one j-slot 503.

Figure 8:
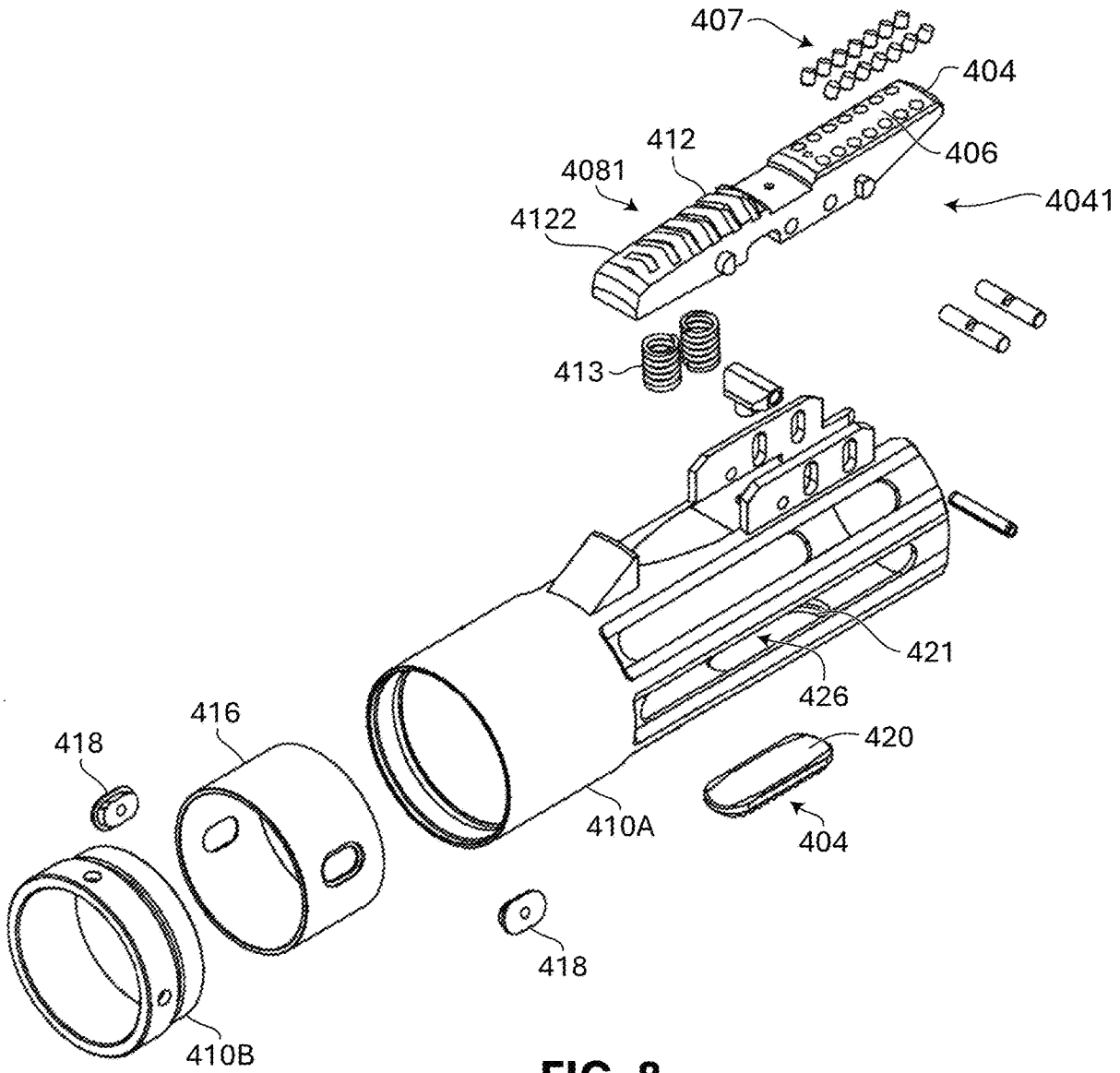
FIG. 8 is an exploded view of an embodiment of an anchoring tool.
Figure 9:
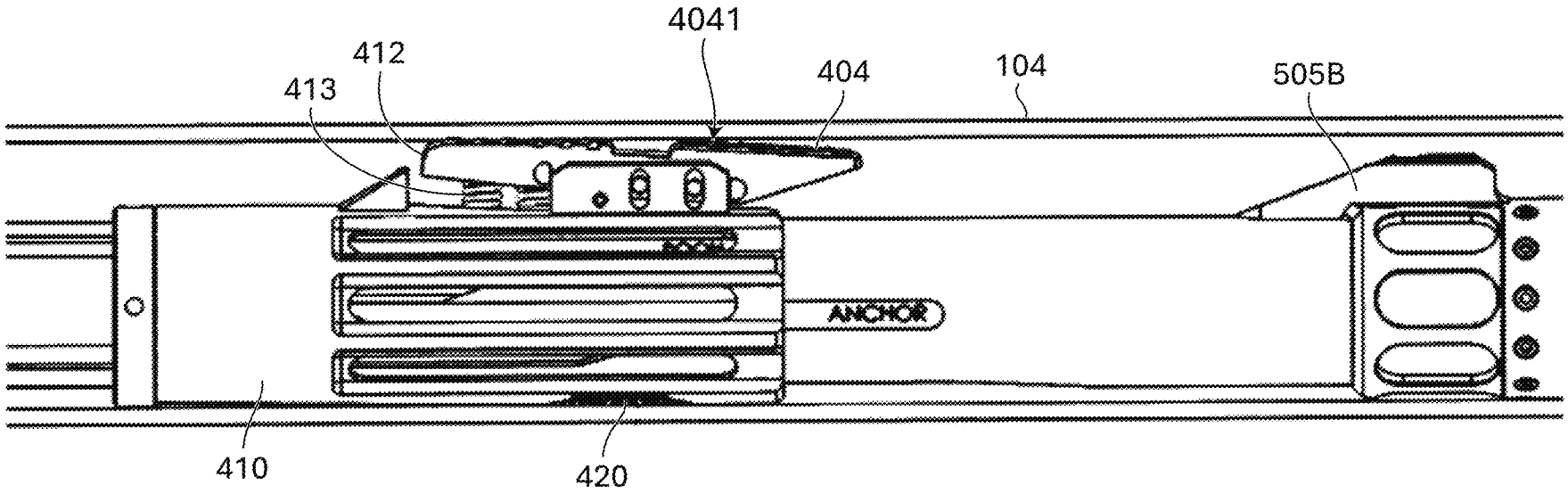
FIG. 9 is a cut-away side view of the anchoring mechanism illustrated in FIG. 1, disposed within casing in an anchoring-ineffective state.
Figure 11:
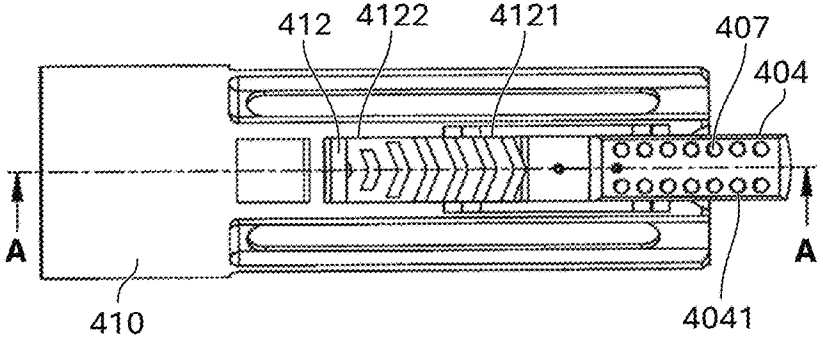
FIG. 11 is a top plan view of the anchoring tool illustrated in FIG. 10.
Figure 10:
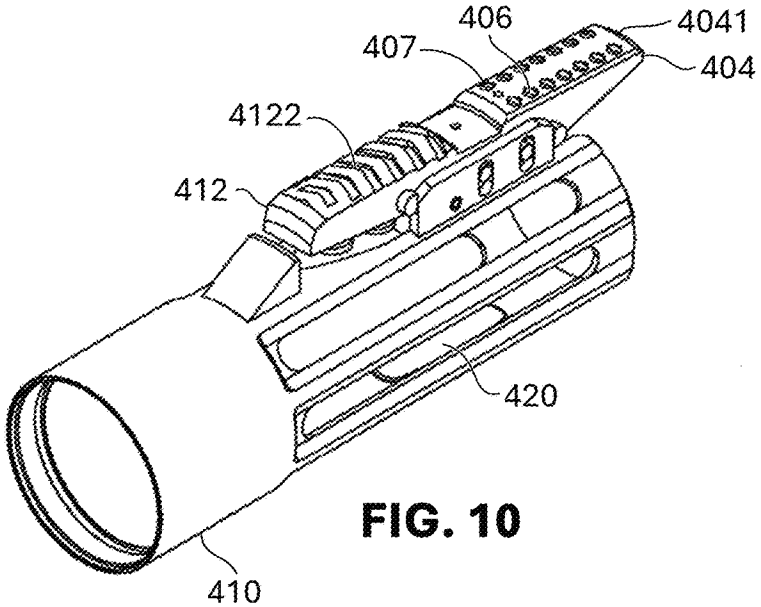
FIG. 10 is a perspective view of an embodiment of an anchoring tool, disposed in an anchoring-ineffective state.
Figure 13:
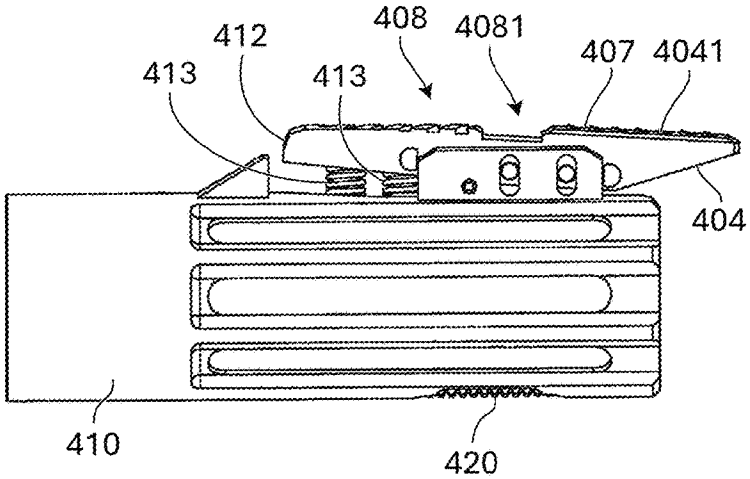
FIG. 13 is a side view of the anchoring tool illustrated in FIG. 11.
Figure 12:
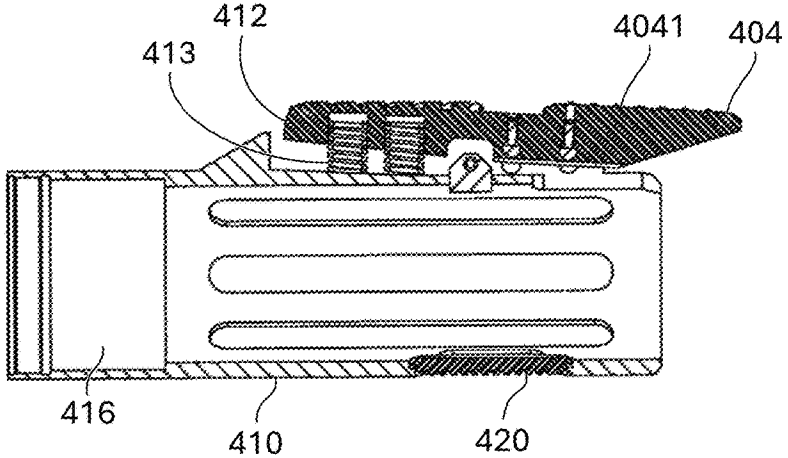
FIG. 12 is a sectional view of the anchoring tool illustrated in FIG. 10, taken along lines A-A in FIG. 11.
Figure 14:
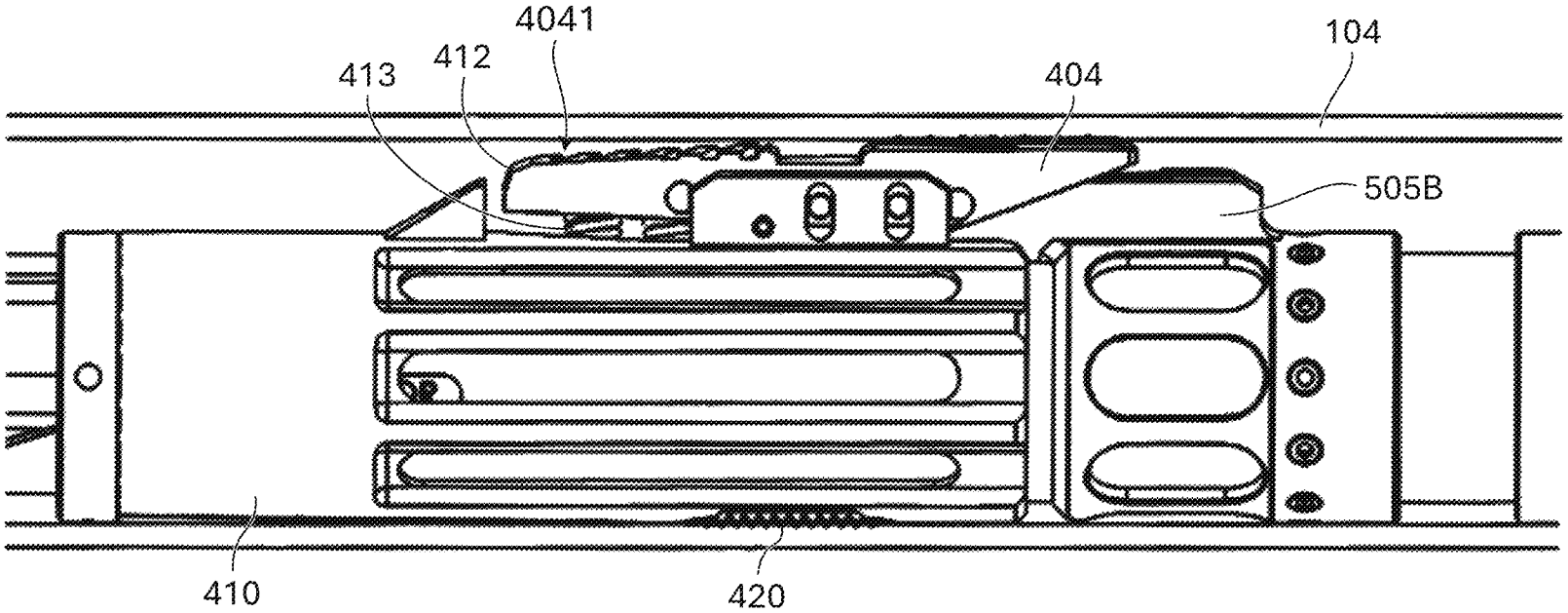
FIG. 14 is a cut-away side view of the anchoring mechanism illustrated in FIG. 1, disposed within casing in an anchoring-effective state.
Figure 16:
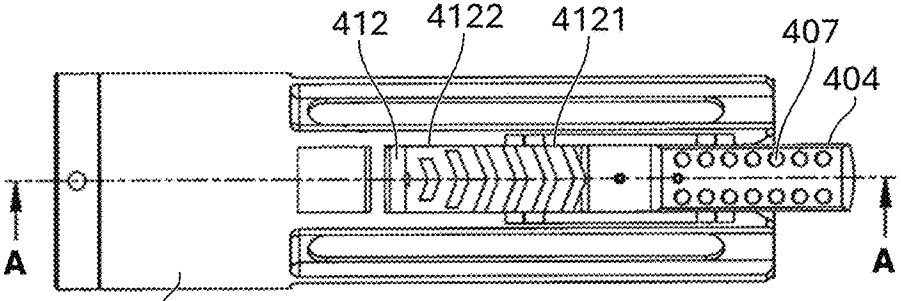
FIG. 16 is a top plan view of the anchoring tool illustrated in FIG. 15.
Figure 18:
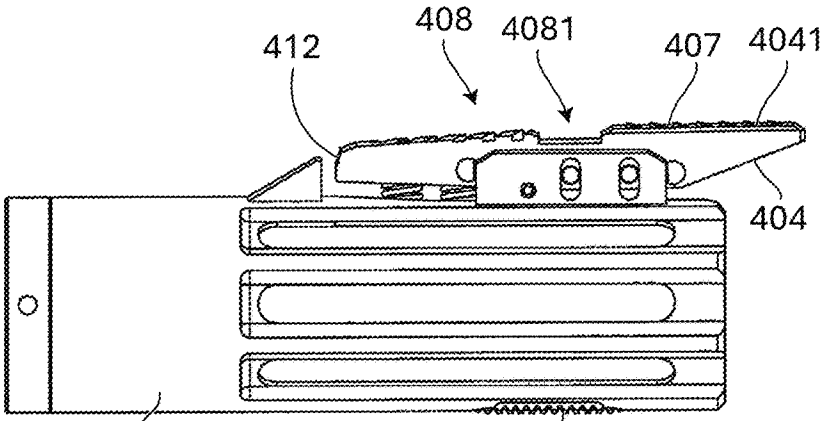
FIG. 18 is a side view of the anchoring tool illustrated in FIG. 15.
Figure 15:
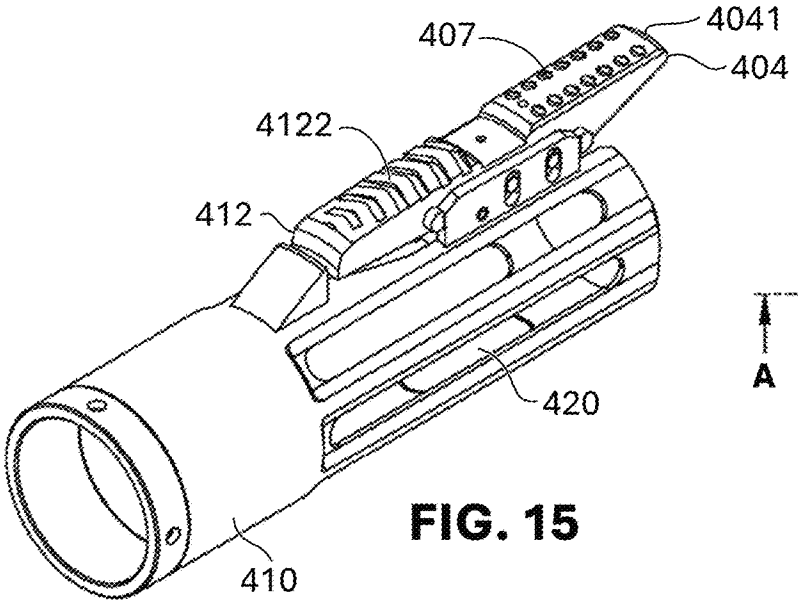
FIG. 15 is a perspective view of the anchoring tool illustrated in FIG. 11, disposed in an anchoring-effective state.
Figure 17:
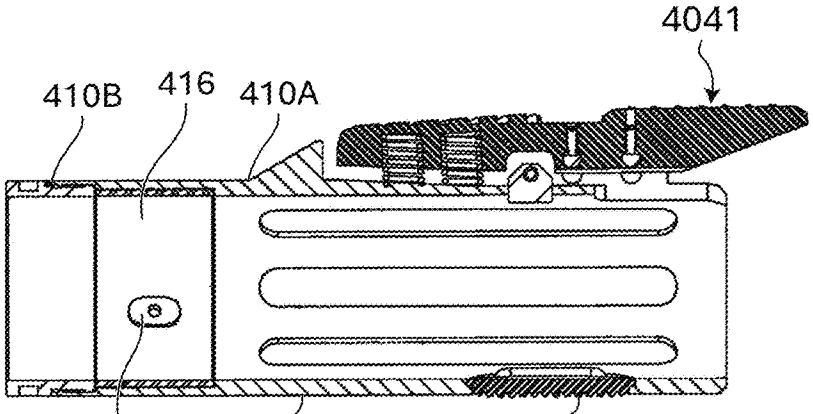
FIG. 17 is a sectional view of the anchoring tool illustrated in FIG. 15, taken along lines A-A in FIG. 16.
Figure 19D:
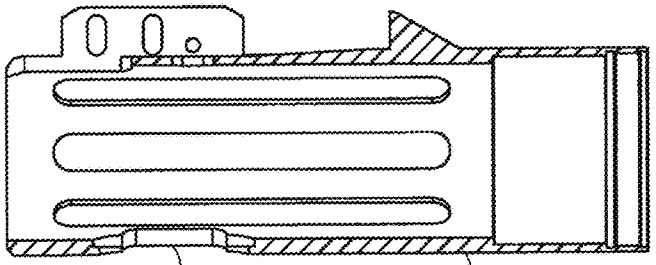
FIG. 19D is a side sectional view of the anchor support illustrated in FIG. 19A, taken along lines B-B in FIG. 19B.
Figure 19E:
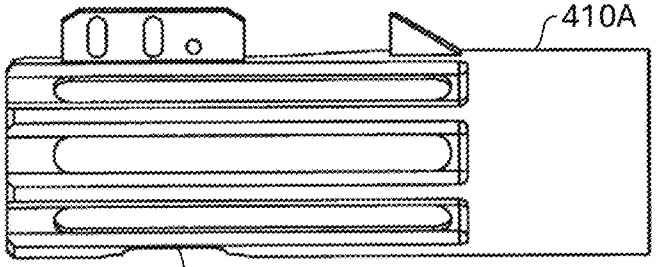
FIG. 19E is a side view of the anchor support illustrated in FIG. 19A.
Figure 19F:
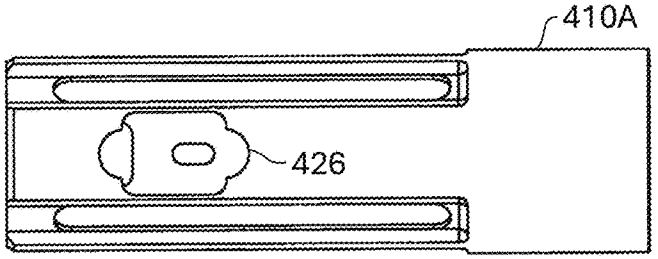
FIG. 19F is a bottom plan view of the anchor support illustrated in FIG. 19A.
Figure 19A:
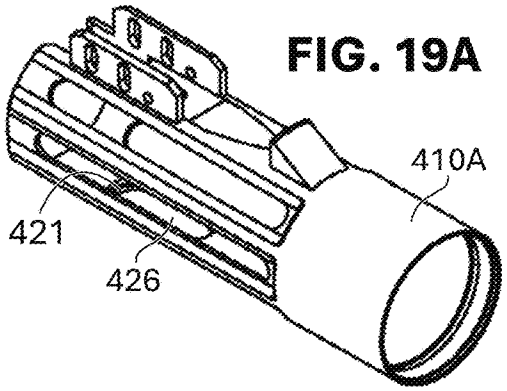
FIG. 19A is a perspective view of an embodiment of an anchor tool support of the anchoring tool illustrated in FIG. 11.
Figure 19B:
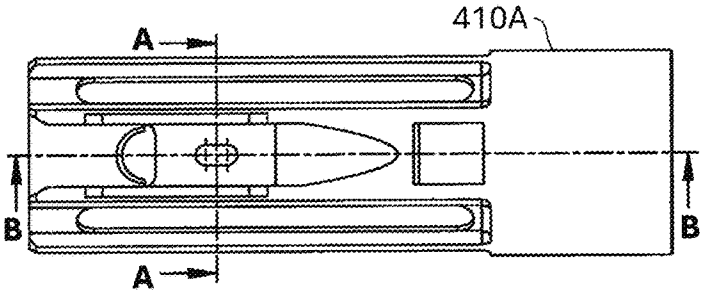
FIG. 19B is a top plan view of an embodiment of the anchor support illustrated in FIG. 19A.
Figure 19C:
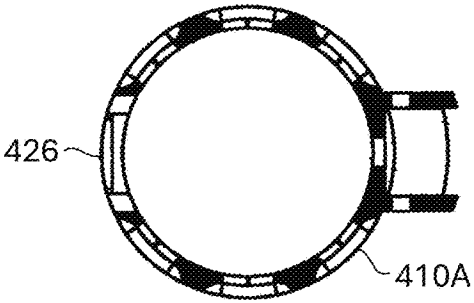
FIG. 19C is a sectional view from one end of the anchor support illustrated in FIG. 19A, taken along lines A-A in FIG. 19B.
Figure 20C:
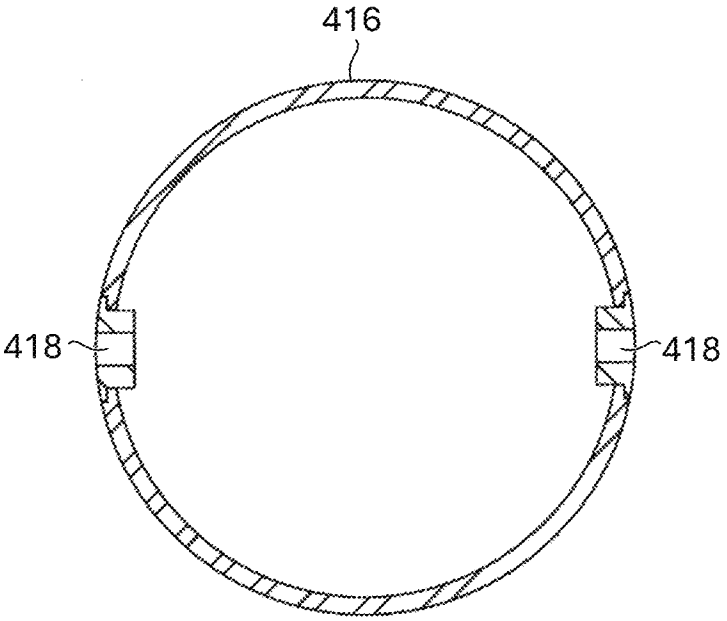
FIG. 20C is a sectional view taken from one end of the pusher illustrated in FIG. 20A, taken along lines A-A in FIG. 20B.
Figure 20B:
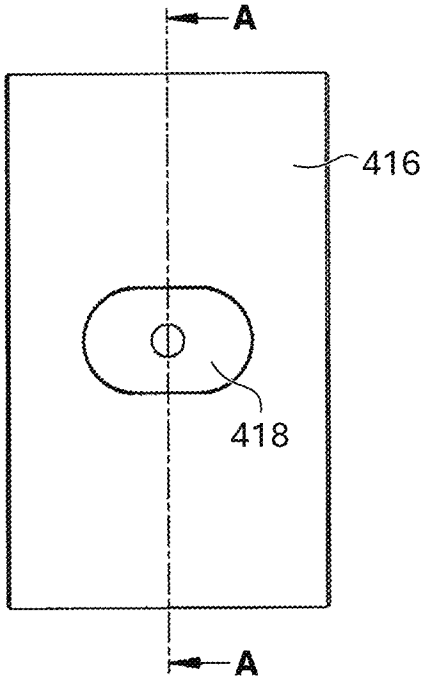
FIG. 20B is a side view of the pusher illustrated in FIG. 20A.
Figure 20A:
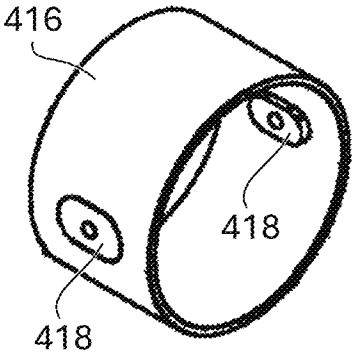
FIG. 20A is a perspective view of a pusher of the anchoring tool illustrated in FIG. 11.

Referring to FIG. 8, in some embodiments, for example, the anchoring tool 400 includes a casing engagement configuration 401 that includes an anchoring configuration 402. The anchoring configuration 402 is defined by at least one anchor 404. Each one of the at least one anchor 404, independently, defines a casing-engaging surface 406 configured for gripping engagement (such as, for example, a "biting" engagement") of the casing 104. In some embodiments, for example, the casing-engaging surface 406 is defined by a slip, such as, for example, a mechanical slip. In some embodiments, for example, the mechanical slip is a button-type slip (e.g. with button inserts 407).

In some embodiments, for example, while the anchoring mechanism 300 is coupled to a flow conductor 200 that is disposed within the wellbore 102 that is lined with the casing 104 and disposed in the anchoring-ineffective state (see FIGS. 9 to 13), each one of the at least one anchor 404, independently, is spaced apart from the casing 104, such that, for each one of the at least one anchor 404, independently, there is an absence of engagement of the casing 104 by the anchor 404.

In some embodiments, for example, while the anchoring mechanism 300 is coupled to a flow conductor 200 that is disposed within the wellbore 102 that is lined with the casing 104 and disposed in the anchoring-effective state (see FIGS. 14 to 18), each one of the at least one anchor 404, independently, is engaged to the casing.

In some embodiments, for example, while the anchoring mechanism 300 is coupled to a flow conductor 200 that is disposed within the wellbore 102 that is lined with the casing 104, the transitioning from the anchoring-ineffective state to the anchoring-effective state is effectuated in response to, for each one of the at least one anchor 404, independently, an outwardly displacement of the anchor 404 relative to the flow conductor 200. In some embodiments, for example, for each one of the at least one anchor 404, independently, the outwardly displacement is with effect that the anchor 404 is displaced from a retracted position to an extended position. In some embodiments, for example, for each one of the at least one anchor 404, independently, the displacement to the extended position is effectuated by rotation of the anchor 404. In this respect, in some embodiments, for example, at least one of the at least one anchor 404 is defined by a rocker 408 that is rotatably mounted to a mandrel 410 (see FIGS. 14-18, 19A-F, and 20A-C, such that the anchoring tool 400 includes the mandrel 410 and at least one rocker 408. In some embodiments, for example, the anchoring mechanism 300 is biased towards the anchoring-ineffective state. In this respect, in those embodiments where at least one of the at least one anchor 404 is defined by a rocker 408, in some of these embodiments, for each one of the at least one anchor 404, one or more biasing members 413 (e.g. a compression spring) is co-operably mounted relative to the mandrel 410 and the rocker 408 such that the anchor 404 is biased towards the retracted position. In some embodiments, for example, the co-operable mounting is such that the biasing member 413 is retained between the mandrel 410 and the rocker 408. In this respect, for example, while the anchoring mechanism 300 is coupled to a flow conductor 200 that is disposed within the wellbore 102 that is lined with the casing 104, in effectuating the transitioning from the anchoring-ineffective state to the anchoring-effective state, the actuator tool 500 overcomes the bias of the biasing member 412.

In some embodiments, for example, at least one of the at least one anchor 404 is a retained anchor 420 that is mounted to the mandrel 410 of the anchoring tool 400. The anchor 420 is displaceable, relative to the mandrel 410, from a respective retracted position to a respective extended position. In the extended position, that is respective to the second anchor, the second anchor projects outwardly through a wellbore string communicator 426 (e.g. a slot). For each one of the at least one retained anchor 420 independently, the actuator tool 500 and the anchoring tool 400 co-operate to define a retainer configuration for retaining the anchor 420, relative to the actuator tool 500. In some embodiments, for example, the mandrel 410, of the anchoring tool 400, defines a lip 421 for becoming disposed in abutting engagement with the anchor 420, while the anchor 420 is disposed in the extended position, such that the retention of the anchor 420, by the retainer configuration, includes retention by the lip 421. For each one of the at least one cavity-retained anchor 420, independently, while the actuator tool 500 is disposed in contact engagement with the retained anchor 420 and the actuator tool 500 is being pulled in the uphole direction, the retained anchor 420 is urged by the actuator tool 500 into contact engagement with the casing 104 via the respective wellbore communicator 426.

In some embodiments, for example, the casing engagement configuration 401 also includes a drag block configuration 410 that is defined by at least one drag block 412. Each one of the at least one drag block 412, independently, defines a casing-engaging surface configured for frictionally resisting axial movement, through the wellbore 102, of the anchoring tool 400 relative to the casing 104. In some embodiments, for example, each one of the at least one drag block 412, independently, the drag block 412 is co-operable with the casing 104, such that, while the anchoring mechanism 300 is coupled to a flow conductor 200 that is disposed within the wellbore 102 that is lined with the casing 104, the drag block 412 is biased for displacement towards the casing 104 for effectuating contact engagement of the drag block 412 with the casing 104, with effect that axial movement of the anchoring tool 400 is resisted.

In some embodiments, for example, the rocker 408 is a rocker 4081 which includes a pair of pads, the uphole one of the pads is defined by an anchor 4041, and the other pad is defined by the drag block 412, and the biasing of the drag block 4121 is effectuated by the biasing member 412. In this respect, in some embodiments, for example, the rocker 4081 is a "rocker slip drag block". In the illustrated embodiment, one of the anchors 404 is defined by a rocker 4081, where a downhole one of the pads is defined by the anchor 4041, and the uphole one of the pads is defined by the drag block 4121, and the actuator tool 500 includes a ramp 505B, respective to the anchor 4041, for effectuating actuation of the anchor 4041.

In some embodiments, for example, the drag block 412 also functions as a casing scraper for engaging the casing 104 for effectuating conditioning of the casing 104. In some embodiments, for example, the casing-engaging surface of the drag block/casing scraper 4122 includes at least one blade (in the illustrated embodiment, the at least one blade is a plurality of v-shaped blades). In some embodiments, for example, the conditioning is with effect that debris (e.g. corrosion and/or scale) is removed from an unconditioned surface portion of the casing 104, with effect that a conditioned surface portion of the casing 104 is obtained, with effect that anchoring of the flow conductor 200 to the casing 104, by the anchor 404, becomes more reliable. In some embodiments, for example, the conditioning includes scraping. In this respect, the anchor 404 and the drag block/scraper 4122 are co-operatively configured such that the drag block/scraper 4122 is effective for selectively conditioning the surface portion of the casing 104 for improving the reliability of anchoring of the flow conductor 200 to the casing 104 via the anchor 404. In some embodiments, for example, the scraping and the anchoring are effected during a single trip. In some embodiments, for example, the drag block/scraper 4122 is aligned with the anchor 404 along a longitudinal axis of the anchoring mechanism 300. In some embodiments, for example, the drag block/scraper 4122 is spaced apart from the anchor 404 by a minimum distance of less than five (5) feet, such as, for example, less than 2½ feet, such as, for example, less than 12 inches. In some embodiments, for example, the biasing of the drag block/casing scraper 4122 towards the casing 104 is for effectuating contact engagement of the drag block/casing scraper 4122 with the casing 104, such that, while the drag block/casing scraper 4122 is disposed in contact engagement with the casing 104, and the anchoring mechanism 300 is being axially displaced through the wellbore, the scraping of the casing portion is being effectuated.

In some embodiments, for example, the at least one anchor 404 and the corresponding at least one wedge are co-operative configured such that, the transitioning of the anchoring mechanism from the actuator-ineffective state to the actuator-effective state is effectuated in response to, for each one of the at least one anchor 404, independently, the outwardly displacement of the anchor 404 urged by a respective one of the at least one wedge 505 in response to contact engagement effectuated between the anchor 404 and the respective one of the at least one wedge 505 while the actuator tool 500 (and, therefore, the respective one of the at least one wedge 505) is being displaced relative to the anchor 404 (such as, for example, while the actuator tool 500 is being pulled uphole relative to the anchoring tool 400), and thereby applying a force to the anchor 404.

In the embodiment illustrated, the anchoring configuration 402 is defined by the anchor 4041, which is defined by the rocker 4081, configured for actuation by the wedge (e.g. ramp) 505B, and the single retained anchor 420 configured for actuation by the wedge (e.g. ramp) 505A (see FIG. 21D), while the actuator tool 500 is being displaced relative to the anchor 404.

Figure 21A:
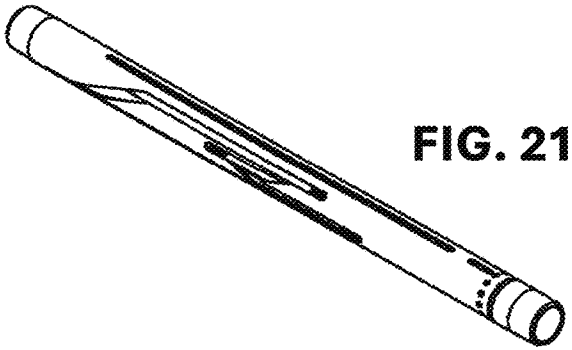
FIG. 21A is a perspective view of a mandrel of the actuator tool illustrated in FIG. 5.
Figure 21B:
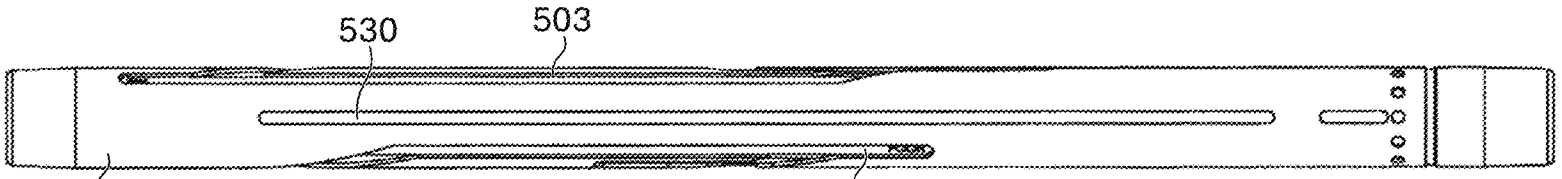
FIG. 21B is a top plan view of the mandrel illustrated in FIG. 21A.
Figure 21C:
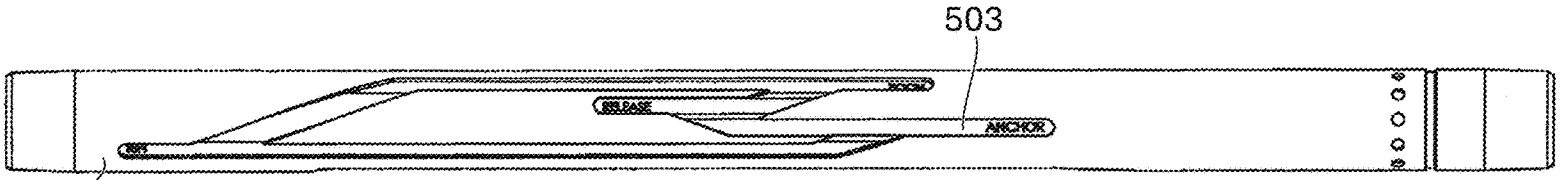
FIG. 21C is a side view of the mandrel illustrated in FIG. 21B.
Figure 21D:
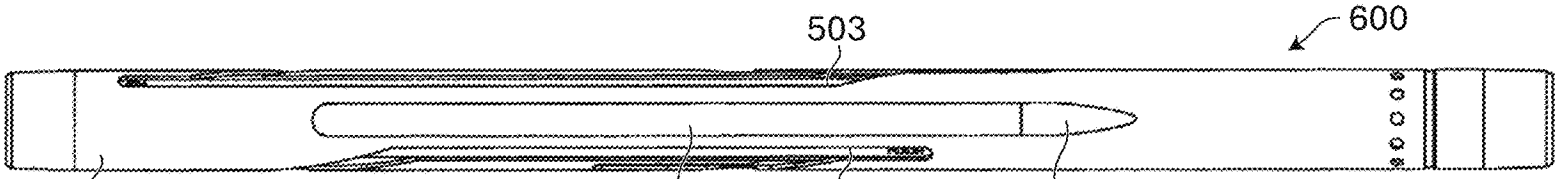
FIG. 21D is a bottom plan view of the mandrel illustrated in FIG. 21B.

Referring to FIG. 21B, in some embodiments, for example, the actuator tool 500 further includes a guide 530 recessed into the exterior surface of the mandrel 602. The guide 530 receives a pin extending from the rocker 408, and the guide 530. The guide 530 and the pin are co-operatively configured such that, while the actuator tool is being displaced relative to the rocker 4081, the guide 530 guides travel towards the wedge 505B for effectuating alignment between the rocker 404 and the wedge 505B.

In some embodiments, for example, the anchor configuration 402 includes a plurality of anchors 404 (such as, for example, the anchors 4041 and 420) that are circumferentially spaced relative to one another. The anchoring tool 400 is co-operable with the casing 104 such that, while the anchoring mechanism 300 is coupled to a flow conductor 200 that is disposed within the wellbore 102 that is lined with the casing 104 and disposed in the anchoring-effective state, the transitioning to the anchoring-effective state is with effect that each one of the plurality of anchors 404, independently, becomes displaced outwardly relative to the central longitudinal axis of the flow conductor 200, such that the anchoring of the flow conductor 200 to the casing 104 is established, and while the anchoring of the flow conductor 200 to the casing 104 is established, for each adjacent pair of anchors 404, independently, the anchors 404 are spaced apart by a minimum distance of at least 0.5 inches.

In some embodiments, for example, the anchoring tool 500 is co-operable with the casing 104 such that, while the anchoring mechanism 300 is coupled to the flow conductor 200 that is disposed within the wellbore 102 that is lined with the casing 104 and disposed in the anchoring-effective state, the flow conductor 200 is eccentrically disposed relative to the central longitudinal axis of the wellbore 102. In some of these embodiments, for example, the eccentric disposition of the flow conductor 200 relative to the central longitudinal axis of the wellbore 102 is such that a ratio of a minimum distance "D1", by which the central longitudinal axis of the flow conductor 200 is spaced apart from the casing 104, to a minimum distance "D2", by which the central longitudinal axis of the wellbore 102 is spaced apart from the casing 104, is less than 0.2, such as, for example, less than 0.175.

In some embodiments, for example, the anchoring tool 500 includes a pair of adjacent anchors 104, and the adjacent anchors 104 is a first anchor and a second anchor (such as, for example, the anchors 4041, 420), and the first anchor 4041 is disposed on an opposite side of the flow conductor 200 relative to a side of the flow conductor 200 on which the second anchor 420 is disposed. The anchoring tool 400 is co-operable with the casing 104 such that, while the anchoring mechanism 300 is coupled to a flow conductor 200 that is disposed within the wellbore 102 that is lined with the casing 104 and disposed in the anchoring-effective state, the transitioning to the anchoring-effective state is with effect that each one of the first and second anchors 4041, 420, independently, becomes displaced outwardly relative to the central longitudinal axis of the flow conductor 200, such that the anchoring of the flow conductor 200 to the casing 104 is effectuated, and a ratio of the outward displacement of the first anchor 4041 to the outward displacement of the second anchor 420 is at least 2.5, such as, for example, at least 3.0.

In some embodiments, for example, the actuator tool 500 extends through the mandrel 410 of the anchoring tool 400, such that the actuation of the anchoring tool 400 by the actuator tool 500 is effectuated by movement of the actuator tool 500 through the mandrel 410.

The actuation of the anchoring tool 400 by the actuator tool 500 is effectuated by co-operation of the j-slot configuration 502 and the anchoring tool 400, while the actuator tool 500 is being pulled uphole within the wellbore 102. In this respect, and referring to FIG. 17 and FIGS. 20A-C, the anchoring tool 400 further includes a pusher 416. The pusher 416 and the casing engagement configuration 401 are co-operatively coupled such that: (i) the casing engagement configuration 401 is movable with the pusher 416, and (ii) the pusher 416 is rotatable relative to the casing engagement configuration 401. In this respect, the pusher 416 and the casing engagement configuration 401 are independently rotatable. In some embodiments, for example, the pusher 416 is contained within the mandrel 410. In this respect, in some embodiments, for example, the mandrel 410 includes an casing engagement configuration support 410A, for supporting the casing engagement configuration 401 (for example, the rotatable mounting of the rocker 408 to the mandrel 410 is defined by the rotatable mounting of the rocker 408 to the support 410A) a retainer 410B, and the pusher 416. The retainer 410B is threadably coupled to the casing engagement configuration support 410A, and the pusher 416 is disposed between the casing engagement configuration support 410A and the retainer 410B. The casing engagement configuration support 410A, the retainer 410B, and the pusher 416 are co-operatively configured such that the threadable coupling of the retainer 410B to the casing engagement configuration support 410A defines space sufficient for retention of the pusher 416 between the retainer 410B and the support 410A such that axial movement of the pusher 416 relative to the retainer 410B and the support 410A is restricted while, in parallel, the pusher 416 is free to rotate relative to the threadably coupled retainer 410B and support 410A.

By providing that the pusher 416 is independently rotatable of the casing engagement configuration 401, application of torque to the casing engagement configuration 401, during rotation of the pusher 416, is mitigated.

In some embodiments, for example, the pusher 416 includes at least one key 418. Each one of the at least one key 418, independently, is configured for travel within a respective one of the at least one j-slot 503 of the j-slot configuration 502. In the illustrated embodiment, the pusher includes two (2) keys 418 each corresponding to a respective one of two (2) j-slots 503 defined within the actuator tool 500. In this respect, while the actuator tool 500 is moved relative to the anchoring tool 400, as the flow conductor 200 is either being moved uphole or downhole within the wellbore 102, for each one of the at least one key 418, while the key 418 is disposed intermediate the termini of the respective j-slot 503, because of resistance effectuated by the drag block configuration 410, the key 418 is traversed by the respective j-slot 503 until becoming disposed in abutting engagement with a terminus within the j-slot 503.

Figure 22:
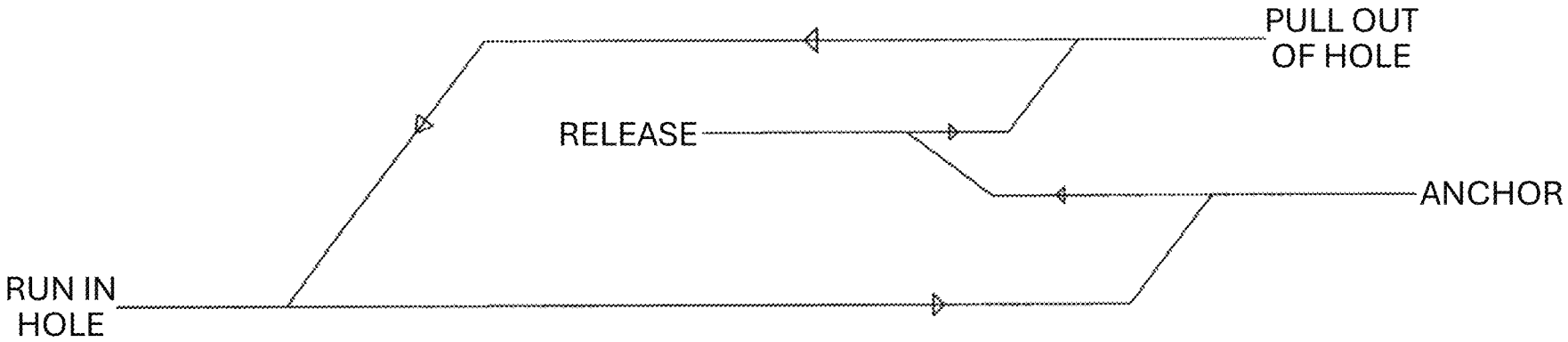
FIG. 22 is identical to FIG. 21C, and identifies the various positions within a j-slot of the mandrel.
Figure 23:
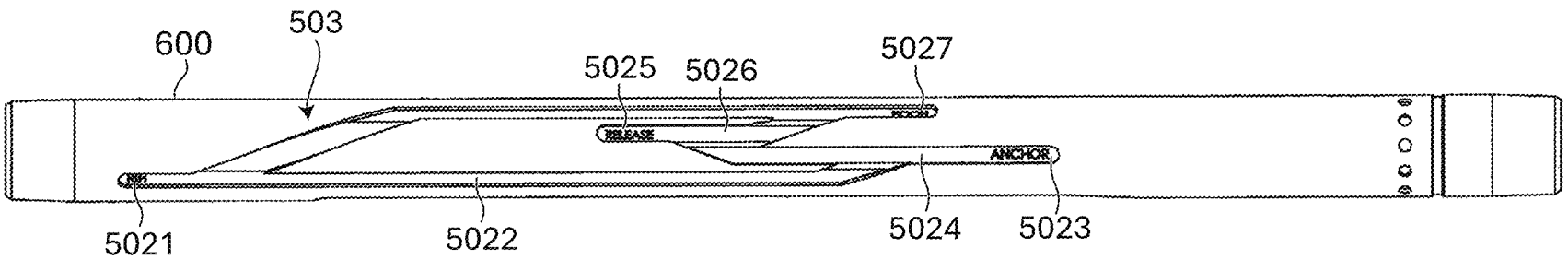
FIG. 23 is a schematic illustration of a representation of the path taken by a key of the pusher through the j-slot illustrated in FIG. 22, including the positions during the "run-in-hole" mode, the "anchor" mode, the "release" mode, and the "pull-out-of-hole" mode.

Referring to FIGS. 22 and 23, during run-in-hole mode, the key 418 is disposed in abutting engagement with a terminus within the j-slot 503, and the downhole force being applied to the actuator tool 500 is transmitted to the key 418 and, therefore, the pusher 416, via the j-slot 503, such that the anchoring tool 400 moves downhole with the flow conductor 200 via the actuator tool 500. During the pull-out-of-hole mode, the key 418 is disposed in abutting engagement with a terminus within the j-slot 503, and the uphole force being applied to the actuator tool 500 is transmitted to the key 418 and, therefore, the pusher 416, via the j-slot 503, such that the anchoring tool 400 moves uphole with the flow conductor 200 via the actuator tool 500. In those sections of the j-slot 503 which are angled relative to the longitudinal axis of the pusher 416, the transmitted force causes rotation of the pusher 416, relative to the casing engagement configuration 401, while axial displacement of the pusher 416 and, therefore, the actuating mandrel 400, is resisted by the drag block configuration 410. The length of one section 5022 of the j-slot 503 is longer than another section 5026 of the j-slot so as to, in the case of section 5022, effectuate deliberate actuation of the anchoring mechanism 300, and, in the case of section 5026, deliberately avoid actuation of the anchoring mechanism 300.

To establish the anchoring of the flow conductor 200 to the casing 104 with the anchoring tool 500, initially, the fluid conductor 200 is run-in-hole through the wellbore 102 to a desired depth ("run-in-hole" mode). During the run-in-hole mode, because of the resistance to displacement by the drag block configuration 410, each one of the keys 418 of the pusher 416, independently, is disposed, or becomes disposed, in a terminus 5021 of the respective j-slot 503. As such, during the run-in-hole mode, the anchoring configuration 402 is disposed in a spaced apart relationship relative to the wedge configuration 504, such that there is an absence of actuation of the anchors 4041, 420 during the run-in-hole mode. After the flow conductor 200 becomes emplaced at the desired depth within the wellbore 102, the flow conductor 200 is pulled uphole during an "anchor mode", with effect that the flow conductor 200 is displaced relative to the anchoring tool 400, whose drag block 4121 is resisting uphole movement, such that each one of the keys 418, of the pusher 416, independently, travels through the j-slot section 5022. The relative displacement, caused by the pulling up of the flow conductor 200, is continued until each one of the keys 418, of the pusher 416, independently, become emplaced within the terminus 5023. Such displacement of the flow conductor 200, relative to the anchoring tool 400 is sufficient to eliminate the spacing between the ramps 505B, 505A and the anchors 4041, 420, with effect that the ramps 505B, 505A engage and urge the actuation of the anchors 4041, 420, such that the flow conductor 202 becomes anchored to the casing 104 by the anchors 4041, 420. At some point, it may be desirable to release the actuation of the anchors 4041, 420 so as to, for example, pull the flow conductor 200 from the wellbore 102. In that case, to release the anchors 4041, 420, the flow conductor 200 is run-in-hole again, thereby retracting the ramps 505B, 505A from the anchors 4041, 420 and effectuating retraction the anchors 4041, 420 from engagement to the casing 104 during a "release" mode. The retraction of the anchors 4041, 420 is confirmed once the keys 418, each having travelled through section 5024 of the respective j-slot 503, by virtue of the frictional resistance of the drag block configuration 410, bottom out against the terminus 5025 of the respective j-slot 503. In order to pull the flow conductor 200 from the wellbore 102 in the "pull-out-of-hole" mode, the flow conductor 200 is pulled uphole, with the frictional resistance of the drag block configuration 410 causing each one of the keys 418, independently, to travel through a j-slot section 5026 of the respective j-slot 503, until bottoming out against the terminus 5027. The terminus 5027 is deliberately positioned uphole relative to the terminus 5023, so as to avoid resetting of the anchors 4041, 420. As the flow conductor 200 is pulled uphole, the anchoring tool 400 is also pulled uphole, by virtue of the disposition of the keys 418 within the terminus 5027 of the j-slots 503.

In some embodiments, for example, it is preferable to avoid actuation of the anchors 404 in response to the application of the force in the uphole direction where it is intended to displace the flow conductor 200 in the uphole direction for coupling a joint to the flow conductor during assembly of the flow conductor, while the anchoring mechanism 300 is already coupled to the flow conductor 200 and disposed downhole within the wellbore 102. Actuating the anchors 404 in these circumstances would interfere with the assembly of the flow conductor 200.

To avoid undesirable actuation of the anchors 404 in these circumstances, the length of the run in hole section portion 5022 of each one of the at least one j-slot 503, independently, is of sufficient length to enable sufficient displacement of the actuator tool 500 relative to the anchoring tool 400 such that, while the flow conductor 200 is being assembled, actuation of the anchors 404 by the actuator tool 500 is avoided. In some embodiments, for example, the length of the run in hole section portion 5022 of each one of the at least one j-slot 503 is greater than a length by which the flow conductor is lifted for coupling of an additional joint of tubing during assembly of the flow conductor 200. In some embodiments, for example, the length of the run in hole section portion 5022 of each one of the at least one j-slot 503 is at least 25% greater than the lift length, such as, for example, at least 50% greater, such as, for example, at least 75% greater, such as, for example, at least 100% greater. In some embodiments, for example, the length of the run in hole section portion 5022 of each one of the at least one j-slot 5022, independently, is greater than 12 inches, such as, for example, greater than 16 inches, such as, for example, greater than 20 inches.

In some embodiments, for example, the actuator tool 500 defines a recessed track 520 (see FIG. 21D) for receiving emplacement of the cavity-retained anchor 420 for a majority (e.g. at least 50%, such as, for example, at least 60%, such as, for example, at least 70%, such as, for example, at least 80%) of a total displacement (wherein the total displacement is, for example, at least 12 inches, such as, for example, at least 16 inches) of the retained anchor 420 that is effectuated for the transitioning of the anchoring mechanism from the actuator ineffective state to the actuator effective state (e.g. the displacement of the keys in the downhole direction effectuated by travel through the j-slot section 4022). Amongst other things, this is for mitigating unnecessary contact between the actuator 420 and the casing 104 during this displacement.

The preceding discussion provides many example embodiments. Although each embodiment represents a single combination of inventive elements, other examples may include all suitable combinations of the disclosed elements. Thus if one embodiment comprises elements A, B, and C, and a second embodiment comprises elements B and D, other remaining combinations of A, B, C, or D, may also be used.

The term "connected" or "coupled to" may include both direct coupling (in which two elements that are coupled to each other contact each other) and indirect coupling (in which at least one additional element is located between the two elements).

Although the embodiments have been described in detail, it should be understood that various changes, substitutions and alterations can be made herein.

Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed, that perform substantially the same function or achieve substantially the same result as the corresponding embodiments described herein may be utilized. Accordingly, the appended claims are intended to include within their scope such processes, machines, manufacture, compositions of matter, means, methods, or steps.

As can be understood, the examples described above and illustrated are intended to be examples only. The invention is defined by the appended claims.

The invention claimed is:

1. An anchoring mechanism including an anchoring tool and an actuator tool, wherein:

the anchoring tool is coupled to the actuator tool such that the actuator tool is axially displaceable relative to the anchoring tool;

the actuator tool includes a respective actuator tool mandrel that defines an actuator tool flow passage, wherein the actuator tool is configured for coupling to a flow conductor, that is emplaceable within a wellbore that is lined with a wellbore string, wherein the coupling is with effect that the actuator tool flow passage is disposed in flow communication with a flow conductor passage of the flow conductor;

the anchoring mechanism is configurable in an anchoring-effective state for effectuating anchoring of the flow conductor to the wellbore string;

the anchoring tool including a respective anchoring tool mandrel, a first anchor, and a second anchor, wherein the first anchor is emplaced on an opposite side of the anchoring tool mandrel relative to a side of the anchoring tool mandrel to which the second anchor is emplaced;

the first anchor is displaceable, relative to the anchoring tool mandrel, that is respective to the anchoring tool, to a respective extended position;

the second anchor is displaceable, relative to the anchoring tool mandrel, to a respective extended position;

the first anchor, the second anchor, and the actuator tool are co-operatively configured such that, while the actuator tool is coupled to a flow conductor that is disposed within the wellbore that is lined with a wellbore string, and the actuator tool is being pulled in the uphole direction, the actuator tool is displaced relative to the anchoring tool, with effect that:

the actuator tool displaces the first anchor to its respective extended position, such that the first anchor becomes displaced outwardly relative to the central longitudinal axis of the flow conductor, with effect that the first anchor becomes anchored to the wellbore string; and the actuator tool displaces the second anchor to its respective extended position, such that the second anchor becomes displaced outwardly relative to the central longitudinal axis of the flow conductor, with effect that the second anchor becomes anchored to the wellbore string;

such that the anchoring mechanism becomes disposed in an anchoring effective state;

and a ratio of the outwardly displacement of the first anchor to the outwardly displacement of the second anchor is at least 2.5.

2. The anchoring mechanism as claimed in claim 1; wherein:

an establishment, of the anchoring effective state, is with effect that eccentric disposition of the flow conductor, relative to the central longitudinal axis of the wellbore, is established.

3. The anchoring mechanism as claimed in claim 2: wherein:

the eccentric disposition of the flow conductor relative to the central longitudinal axis of the wellbore is such that a ratio of a minimum distance "D1", by which the central longitudinal axis of the flow conductor is spaced apart from the wellbore string, to a minimum distance "D2", by which the central longitudinal axis of the wellbore is spaced apart from the wellbore string, is less than 0.2.

4. The anchoring mechanism as claimed in claim 3; wherein:

the anchoring mechanism is co-operable with the wellbore string such that, while: (i) the anchoring mechanism is coupled to the flow conductor that is disposed within the wellbore that is lined with the wellbore string, and (ii) the anchoring mechanism is disposed in the anchoring-effective state such that the flow conductor is anchored by the anchoring mechanism to the wellbore string, the first and second anchors are spaced apart by a minimum distance of at least 0.5 inches.

5. The anchoring mechanism as claimed in claim 4; wherein:

the first anchor and the second anchor are circumferentially spaced-apart relative to one another.

6. The anchoring mechanism as claimed in claim 4; wherein:

each one of the first anchor and the second anchor, independently, defines an engagement surface, defined by a mechanical slip, for engaging the wellbore string for establishing anchoring, of the anchor, to the wellbore string.

7. The anchoring mechanism as claimed in claim 1; wherein:

in the anchoring effective state, a ratio of a minimum distance "D1", by which the central longitudinal axis of the flow conductor is spaced apart from the wellbore string, to a minimum distance "D2", by which the central longitudinal axis of the wellbore is spaced apart from the wellbore string, is less than 0.2.

8. The anchoring mechanism as claimed in claim 1; wherein:

the anchoring mechanism is co-operable with the wellbore string such that, while: (i) the anchoring mechanism is coupled to the flow conductor that is disposed within the wellbore that is lined with the wellbore string, and (ii) the anchoring mechanism is disposed in the anchoring-effective state such that the flow conductor is anchored by the anchoring mechanism to the wellbore string, the first anchor and the second anchor are spaced apart by a minimum distance of at least 0.5 inches.

9. The anchoring mechanism as claimed in claim 1; wherein:

the first anchor and the second anchor are circumferentially spaced-apart relative to one another.

10. The anchoring mechanism as claimed in claim 1; wherein:

each one of the first anchor and the second anchors, independently, defines an engagement surface, defined by a mechanical slip, for engaging the wellbore string for establishing anchoring, of the anchor, to the wellbore string.

11. The anchoring mechanism as claimed in claim 1; wherein:

the actuator tool extends through the anchoring tool.

12. The anchoring mechanism as claimed in claim 11; wherein:

in the anchoring effective state, a ratio of a minimum distance "D1", by which the central longitudinal axis of the flow conductor is spaced apart from the wellbore string, to a minimum distance "D2", by which the central longitudinal axis of the wellbore is spaced apart from the wellbore string, is less than 0.2.

13. The anchoring mechanism as claimed in claim 12; wherein:

the anchoring mechanism is co-operable with the wellbore string such that, while: (i) the anchoring mechanism is coupled to the flow conductor that is disposed within the wellbore that is lined with the wellbore string, and (ii) the anchoring mechanism is disposed in the anchoring-effective state such that the flow conductor is anchored by the anchoring mechanism to the wellbore string, the first and second anchors are spaced apart by a minimum distance of at least 0.5 inches.

14. The anchoring mechanism as claimed in claim 13; wherein:

the first anchor and the second anchor are circumferentially spaced-apart relative to one another.

15. The anchoring mechanism as claimed in claim 13; wherein:

each one of the first anchor and the second anchor, independently, defines an engagement surface, defined by a mechanical slip, for engaging the wellbore string for establishing anchoring, of the anchor, to the wellbore string.

16. The anchoring mechanism as claimed in claim 1; wherein: the actuator tool extends through the anchoring tool mandrel of the anchoring tool.

17. An anchoring mechanism including an anchoring tool and an actuator tool, wherein the anchoring tool is coupled to the actuator tool such that the actuator tool is axially displaceable relative to the anchoring tool;

wherein:

the actuator fool defines an actuator tool flow passage, wherein the actuator tool is configured for coupling to a flow conductor, that is emplaceable within a wellbore that is lined with a wellbore string, wherein the coupling is with effect that the actuator tool flow passage is disposed in flow communication with a flow conductor passage of the flow conductor;

the anchoring mechanism is configurable in an anchoring-effective state for effectuating anchoring of the flow conductor to the wellbore string;

the anchoring tool including an anchoring tool mandrel, a first anchor, and a second anchor, wherein:

the anchoring tool mandrel defines a wellbore string communicator the first anchor is emplaced on an opposite side of the anchoring tool mandrel relative to a side of the anchoring tool mandrel to which the second anchor is emplaced;

the first anchor is displaceable, relative to the anchoring tool mandrel, from a respective retracted position to a respective extended position; and the second anchor is displaceable, relative to the anchoring tool mandrel, from a respective retracted position to a respective extended position, wherein, in the extended position, that is respective to the second anchor, the second anchor projects outwardly through the wellbore string communicator;

the actuator tool extends through the anchoring tool mandrel of the anchoring tool;

the first anchor, the second anchor, and the actuator tool are co-operatively configured such that, while the actuator tool is coupled to a flow conductor that is disposed within the wellbore that is lined with the wellbore string, and the actuator tool is being pulled in the uphole direction, the actuator tool is displaced relative to the anchoring tool, with effect that:

the actuator tool displaces the first anchor to the extended position, that is respective to the first anchor, such that the first anchor becomes displaced outwardly relative to the central longitudinal axis of the flow conductor, with effect that the first anchor becomes anchored to the wellbore string; and the actuator tool displaces the second anchor to the extended position, that is respective to the second anchor, such that the second anchor becomes displaced outwardly, relative to the central longitudinal axis of the flow conductor, with effect that the second anchor becomes anchored to the wellbore string, such that the anchoring mechanism becomes disposed in an anchoring effective state;

the emplacement of the first anchor, relative to the anchoring tool mandrel, is such that the first anchor is coupled to the anchoring tool mandrel for rotation relative to the anchoring tool mandrel, such that the displacement, of the first anchor, to the extended position, that is respective to the first anchor, is effectuated by the rotation of the first anchor;

the actuator tool and the anchoring tool co-operate to define a retainer configuration for retaining the second anchor, relative to the actuator tool, such that the emplacement of the second anchor, relative to the anchoring tool mandrel, is such that the second anchor is retained relative to the anchoring tool mandrel by the retainer configuration.

18. The anchoring mechanism as claimed in claim 17; wherein the retention, by the retainer configuration, is based on an abutting engagement between the retainer and the second anchor.

19. The anchoring mechanism as claimed in claim 17; wherein:

the mounting, of the first anchor to the anchoring tool mandrel, is such that the first anchor is biased towards a retracted position.

20. The anchoring mechanism as claimed in claim 17; wherein:

each one of the first anchor and the second anchor, independently, defines an engagement surface, defined by a mechanical slip, for engaging the wellbore string for establishing anchoring, of the anchor, to the wellbore string.

* * * * *